United States Patent [19]

Litchfield et al.

[11] 4,219,247

[45] Aug. 26, 1980

[54] SUSPENDED FILING DRAWER

[75] Inventors: Leon G. Litchfield; Terence Hardy, both of Belper, England

[73] Assignee: L. B. (Plastics) Limited, Derbyshire, England

[21] Appl. No.: 4,592

[22] Filed: Jan. 18, 1979

Related U.S. Application Data

[63] Continuation of Ser. No. 777,430, Mar. 14, 1977, abandoned.

[30] Foreign Application Priority Data

Apr. 10, 1976 [GB] United Kingdom ..... 14739/76

[51] Int. Cl.[2] ..... A47B 63/00

[52] U.S. Cl. ..... 312/184; 312/214; 312/330 R; 211/46

[58] Field of Search ..... 312/184, 183, 188, 192, 312/214, 330 R; 211/46

[56] References Cited

U.S. PATENT DOCUMENTS

| | | | |
|---|---|---|---|
| 1,136,071 | 4/1915 | Weiss | 312/214 |
| 1,524,348 | 1/1925 | Field | 211/46 |
| 2,278,403 | 3/1942 | Jonas | 312/184 |
| 2,925,086 | 2/1960 | Stark | 312/184 |
| 3,556,626 | 1/1971 | Schock | 312/214 |
| 3,647,101 | 3/1972 | Hensch et al. | 312/184 |
| 3,901,572 | 8/1975 | Litchfield | 312/330 R |
| 3,999,663 | 12/1976 | Walter et al. | 312/184 |
| 4,030,610 | 6/1977 | Alexander | 312/184 |

FOREIGN PATENT DOCUMENTS

| | | | |
|---|---|---|---|
| 116552 | 6/1946 | Sweden | 312/184 |
| 1392534 | 4/1975 | United Kingdom | 312/184 |

*Primary Examiner*—Victor N. Sakran
*Attorney, Agent, or Firm*—Marshall & Yeasting

[57] ABSTRACT

A suspended filing drawer having a relatively low back and sides and a relatively high front and a file supporting assembly mounted on the low section of the drawer and connected to the rear face of the drawer front, the file supporting assembly including parallel rails for the accommodation of suspended files. The drawer may be of "knock-down" construction comprising separate side, back and front panels interconnected by connecting pieces whereby the drawer may be stored and transported in a "knocked-down" or disassembled condition and erected subsequently.

6 Claims, 10 Drawing Figures

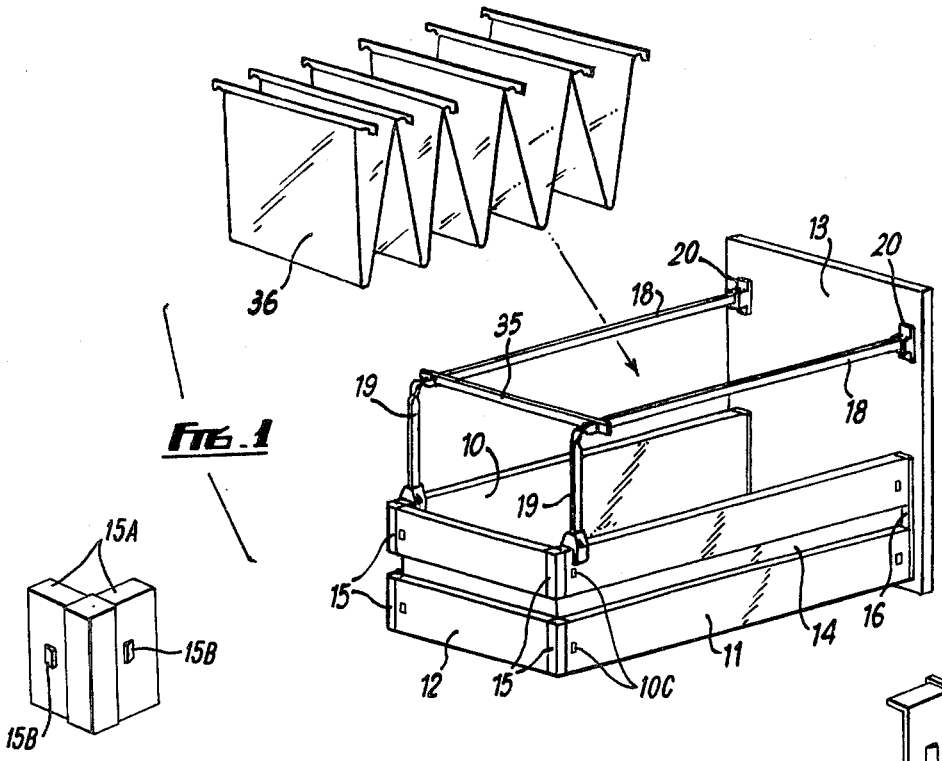
FIG. 1
FIG. 1A
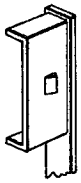
FIG. 1B
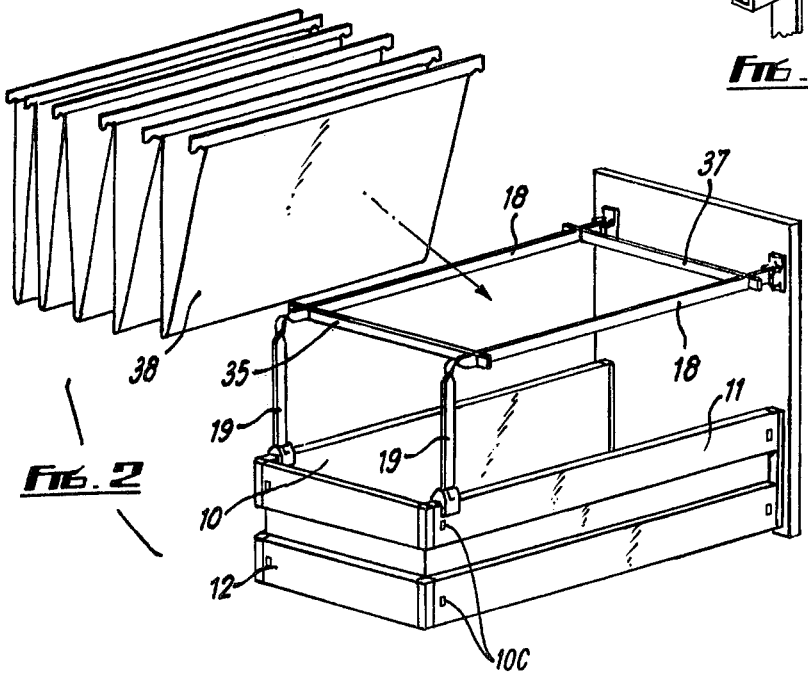
FIG. 2

SUSPENDED FILING DRAWER

This is a continuation of application Ser. No. 777,430 filed Mar. 14, 1977 now abandoned.

The invention relates to drawers and especially to drawers adapted for the accommodation of so-called "suspended filing" systems.

It is an object of the present invention to provide means whereby a suspended filing drawer may be constructed using components of a standard relatively shallow drawer thereby obviating the need to construct a custom built drawer for filing purposes.

The invention provides a suspended filing drawer having relatively low sides and back and a relatively high front and a file supporting assembly mounted on the low section of the drawer and connected to the rear face of the drawer front, the file supporting assembly including parallel rails for the accommodation of suspended files.

Preferably the drawer is of so-called "knock-down" construction comprising separate side, back and front panels which may be interconnected by connecting pieces whereby the drawer may be stored and transported in a "knocked down" or disassembled condition and erected subsequently.

Preferably the side and back panels are of extruded construction and are interconnected by corner pieces having projecting lugs engageable in the hollow extrusions. The lugs are preferably provided with detents engageable in holes formed in the extrusions so as to lock the parts securely together. The side and back walls may constitute components utilised in the assembly of a normal relatively shallow drawer such as those used in kitchen and bedroom furniture. In this way a filing drawer may be constructed utilising components common to other types of drawer thereby reducing production costs.

Preferably the file supporting assembly comprises a pair of spaced horizontal bars mounted so as to extend parallel to and above the side walls and a pair of spaced vertical bars supported on the back or side walls of the drawer and extending upwardly to meet the horisontal bars. The vertical and horizontal bars are preferably formed integrally, the horizontal bars being interconnected adjacent their rear ends by a further horizontal bar extending parallel to the back wall of the drawer. Preferably also means is provided for attachment of an additional horizontal bar in a position adjacent and parallel to the front wall of the drawer. By appropriate selection of the spacing of the respective pairs of horizontal bars, the drawer may be adapted to accommodate files extending longitudinally or transversely.

Preferably also the file supporting assembly is bodily removable from the drawer without disassembly. Thus the invention also provides a suspended filing drawer comprising a drawer body and a file suspending assembly connected to the drawer body in a detachable manner so as to be bodily removable together with files suspended thereon.

An embodi-ment of the invention will now be described, by way of example only, with reference to the accompanying drawings, in which:

FIG. 1 is a perspective view of one form of suspended filing drawer according to the invention;

FIG. 1A is an enlarged fragmentary perspective view of a corner piece incorporated on the drawer of FIG. 1;

FIG. 1B is a similar view of FIG. 1A showing a front fixing member;

FIG. 2 is a similar view showing a modification of the drawer shown in FIG. 1;

Figure 3:
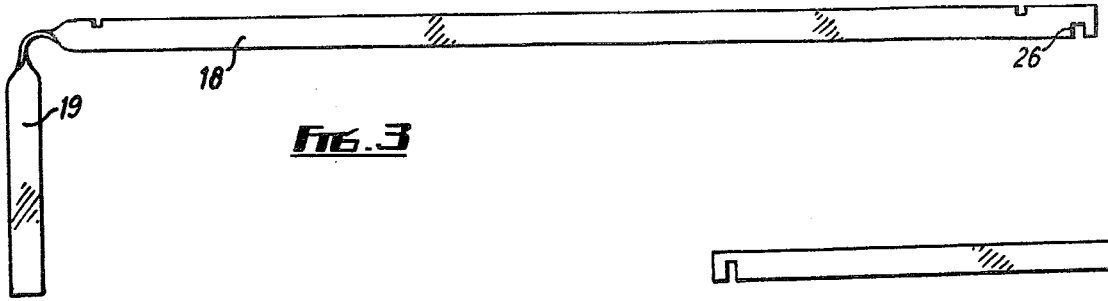
FIGS. 3 and 4 show details of the support bars incorporated in the file suspending assembly.
Figure 4:
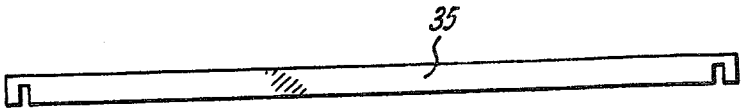

Referring to FIG. 1, there is shown a suspended filing drawer comprising sides 10, 11 a back 12 and a front 13, the sides and back being of the same relatively low height and the front being considerably higher. The sides and back comprise extruded panels having longitudinal recesses 14 approximately midway of their height, the recesses in the side walls forming tracks or channels for engagement with drawer runners forming part of a cabinet or other structure to which the drawer is to be fitted. The sections above and below the channels 14 are hollow and the sides and back are interconnected by corner pieces 15 having projections 15A which engage in the hollow ends of the panels to secure same together. The projections may be secured in place by means of adhesive but are preferably secured by means of detents 15B which project therefrom and engage in holes 15C formed in the side and back walls. In this way the parts may be assembled without the use of adhesive and can be taken apart subsequently if required. The forward ends of the drawer sides are secured to the drawer front by means of fixing members 16 screwed to the rear of the drawer front 13 and having projections which engage in the ends of the side walls. These fittings may be retained in position by adhesive or by detents of the kind referred to above. Before attachment of the drawer front 13, a floor panel may be engaged in inwardly directed grooves (not visible) formed towards the lower edges of the side and back walls.

Figure 6:
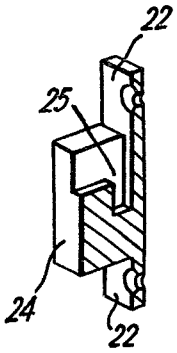
FIG. 6 is a vertical cross-section on the centre line of the device shown in FIG. 5.
Figure 5:
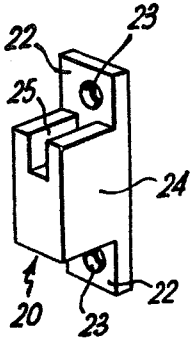
FIG. 5 is a perspective view of a front attachment member utilised to secure the file supporting assembly to the drawer.

Supported on the drawer thus formed is a file supporting assembly comprising a pair of horizontal bars 18 extending parallel to and above the side walls 10, 11. The bars 18 are formed with integral extensions 19 which are disposed at 90° to the bars 18 and are supported at their lower ends on the side walls 10, 11 adjacent to the rear wall 12. The forward ends of the bars 18 are connected to the front wall 13 by fastening devices 20 one of which is shown in greater detail in FIGS. 5 and 6. This comprises a plastic moulding having a base plate 22 provided with holes 23 adjacent its ends through which screws may be passed to secure the fitting to the rear face of the drawer front. The base plate 22 carries a locating member 24 the upper face of which is provided with a slot 25 of inverted hook shape engageable with complementary formations 26 at the forward end of the bars 18. The arrangement is such that once engaged with the fastening devices the bars 18 can only be removed upwardly to disengage the formations 26 and slots 25.

Figure 7:
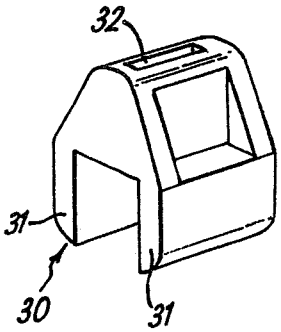
FIG. 7 is a perspective view of an attachment device for mounting the file supporting assembly on the rear of the drawer.

The lower ends of the vertical bars 19 are supported on the sides of the drawer adjacent to the rear wall by locating devices 30 one of which is shown in greater detail in FIG. 7. Each device is of generally inverted U-shaped form having spaced legs 31 engageable over the upper edge of the drawer side and spaced so that the device is a tight fit thereon. A slot 32 is formed in the upper end of the device 30 and is dimensioned to correspond to cross-section to that of the bars 19. The lower ends of the bars may thus be engaged in the slots 32 and are restrained against movement in all directions other than upwardly.

Figure 8:
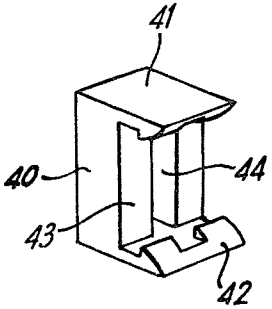
FIG. 8 is a perspective view of a clip member forming part of the file supporting assembly.

A further horizontal bar 35 interconnects the bars 18 adjacent the rear of the drawer and extends parallel to the drawer back 12. In the arrangement shown in FIG. 1 of the drawings, this bar 35 serves to rigidify the file supporting assembly and when in place suspended files indicated at 36 in the drawings may be engaged with the bars 18 so as to extend across the drawer, that is parallel to the back and front walls. The cross-bar 35 is locked to the bars 18 by locking devices (not shown in FIG. 1 or FIG. 2) engaged over the co-operating parts of the two bars at opposite ends of the cross-bar. One such locking device is shown in detail in FIG. 8 and comprises a body 40 having upper and lower projecting lugs 41 formed with interned lips 42 defining a recess 43 for accommodation of the associated bar 18 and having a vertical slot 44 for accommodation of the free end of the associated cross-bar 35. The locking devices secure the bars 18 and 35 against relative movement in all directions.

In the arrangement shown in FIG. 2 of the drawings, an additional cross-bar 37 extends between the bars 18 in a position adjacent and parallel to the drawer front 13. In this instance the cross-bars 35 and 37 are so spaced as to accommodate the ends of a suspended filing system shown at 38 in FIG. 2 which is supported on the cross-bars 35, 36 with the files extending longitudinally of the drawer. It will be appreciated that by appropriate spacing of the bars 18, 35 and 37 the same basic drawer construction can be utilised to accommodate either form of suspended filing by removing or inserting the cross-bar 37 as required.

Filing drawers of the kind described posses several advantages compared with conventional filing drawers. Since they can be constructed in "knock-down" form they may be readily transported and stored utilising the minimum of space and can then be erected by the purchaser when required. By utilisation of sides and back of a standard depth corresponding to that of drawers for purposes other than suspended filing, there is no need to construct custom built suspended filing drawers and manufacturing costs are therefore substantially reduced. When constructed from extruded plastics materials the drawers are extremely light and a further advantage resides in the fact that the file supporting assembly may be removed bodily from the drawer and fitted to another drawer without disturbing the filing system itself.

Various modifications may be made without departing from the invention. For example the sides and back of the drawer need not be formed from extruded plastics material and need not be of "knock-down" construction. Different forms of file supporting assembly could be utilised and could be attached to the remainder of the drawer in different ways. File supporting assemblies could be produced to fit various different sizes and depths of standard drawer by altering the height of the vertical bars 19 and the widths of the or each cross-bar. The file supporting assembly could also be adapted for supporting files of different widths by providing different lengths of side bars or by providing for attachment of the cross-bars in different positions.

We claim:

1. A suspended filing drawer having a relatively low back and sides forming a low section and a relatively high front, the back and sides being formed from hollow extruded panels having their ends open, means received in the open ends for so interconnecting the back, sides and front of the drawer that said back, sides and front may be stored and transported in a disassembled condition, and a file supporting assembly detachably connected to the low section and to the front and including a pair of spaced horizontal rails mounted so as to extend parallel to and above the sides of the drawer, a pair of spaced vertical bars connected to the horizontal rails and supported on the rear of said low section to extend upwardly to the horizontal rails, a horizontal bar detachably interconnecting the rear ends of the horizontal rails extending parallel to the back of the drawer, a first fastening device for each of the rails fixed to the rear of the front of the drawer and having an upwardly opening slot receiving the respective end of a horizontal rail, and a second fastening device for each of the vertical bars carried by said rear of the low section and having an upwardly opening slot for receiving the respective end of a vertical bar, whereby the file supporting assembly is bodily removable from the drawer.

2. A suspended filing drawer as claimed in claim 1 in which said means for interconnecting the back, sides and front of the drawer comprise corner pieces having projecting lugs engageable in the open ends of the hollow extruded panels, said lugs being provided with detents engageable in holes formed in the panels so as to lock the parts together.

3. A suspended filing drawer as claimed in claim 1 wherein each of said first fastening devices has an upwardly opening slot adapted to receive a complementary formation provided on the end of the associated horizontal rail.

4. A suspended filing drawer as claimed in claim 1 in which each of said second fastening devices is of generally inverted U-shape, having legs spaced so as to tightly embrace a drawer panel and having a slot in its upper end to receive and locate the associated vertical bar.

5. A suspended filing drawer as claimed in claim 1 including an additional horizontal bar adjacent and parallel to the front of the drawer, said additional horizontal bar being detachable, and both said horizontal bars being adapted to locate and support suspended files.

6. A suspended filing drawer according to claim 5 including locking devices to locate said horizontal bars on said horizontal rails, each locking device including a body having upper and lower projecting lugs formed with lips defining a recess for accommodation of the associated rail and a slot for accommodation of the associated bar.

* * * * *